US012049601B2

(12) United States Patent
Monden et al.

(10) Patent No.: US 12,049,601 B2
(45) **Date of Patent: *Jul. 30, 2024**

(54) METHOD FOR PRODUCING LUBRICATING OIL COMPOSITION, AND LUBRICATING OIL COMPOSITION

(71) Applicant: RESONAC CORPORATION, Tokyo (JP)

(72) Inventors: Ryuji Monden, Tokyo (JP); Kunio Kondo, Tokyo (JP)

(73) Assignee: MITSUBISHI CORPORATION, Tokyo (JP)

( * ) Notice: Subject to any disclaimer, the term of this patent is extended or adjusted under 35 U.S.C. 154(b) by 315 days.

This patent is subject to a terminal disclaimer.

(21) Appl. No.: 17/605,309

(22) PCT Filed: Apr. 23, 2020

(86) PCT No.: PCT/JP2020/017423

§ 371 (c)(1),
(2) Date: Oct. 21, 2021

(87) PCT Pub. No.: WO2020/218391

PCT Pub. Date: Oct. 29, 2020

(65) Prior Publication Data

US 2022/0228084 A1 Jul. 21, 2022

(30) Foreign Application Priority Data

Apr. 24, 2019 (JP) ..... 2019-083261

(51) Int. Cl.

| | |
|---|---|
| ***C10M 177/00*** | (2006.01) |
| ***C10M 105/04*** | (2006.01) |
| ***C10M 105/68*** | (2006.01) |
| ***C10M 125/02*** | (2006.01) |
| ***C10M 169/04*** | (2006.01) |
| *C10N 20/00* | (2006.01) |
| *C10N 70/00* | (2006.01) |

(52) U.S. Cl.

CPC ..... *C10M 177/00* (2013.01); *C10M 105/04* (2013.01); *C10M 105/68* (2013.01); *C10M 125/02* (2013.01); *C10M 169/04* (2013.01); *C10M 2201/041* (2013.01); *C10M 2203/0206* (2013.01); *C10M 2203/022* (2013.01); *C10M 2215/0865* (2013.01); *C10N 2020/077* (2020.05); *C10N 2070/00* (2013.01)

(58) Field of Classification Search

CPC ..... C10M 177/00; C10M 105/04; C10M 105/68; C10M 125/02; C10M 169/04; C10M 2201/041; C10M 2203/0206; C10M 2203/022; C10M 2215/0865; C10M 107/46; C10M 2203/04; C10M 127/02; C10M 2203/045; C10N 2020/077; C10N 2070/00; C10N 2020/04; C10N 2030/06

See application file for complete search history.

(56) References Cited

U.S. PATENT DOCUMENTS

| | | | |
|---|---|---|---|
| 5,292,444 | A | 3/1994 | Patil et al. |
| 5,462,680 | A | 10/1995 | Brois et al. |
| 5,503,643 | A | 4/1996 | Schriver et al. |
| 8,883,124 | B2 | 11/2014 | Krishna et al. |
| 11,214,749 | B2 | 1/2022 | Monden et al. |
| 2002/0031615 | A1 | 3/2002 | Dykes et al. |
| 2014/0312281 | A1 | 10/2014 | Jackson et al. |
| 2015/0162044 | A1 | 6/2015 | Hanawa et al. |
| 2016/0160148 | A1 | 6/2016 | Rai |
| 2019/0032971 | A1 | 1/2019 | Ishida et al. |
| 2020/0194677 | A1 | 6/2020 | Richter et al. |
| 2020/0299601 | A1 | 9/2020 | Horie et al. |
| 2020/0339904 | A1 | 10/2020 | Monden et al. |
| 2021/0222083 | A1 | 7/2021 | Monden et al. |
| 2021/0253968 | A1 | 8/2021 | Kato et al. |
| 2021/0371763 | A1 | 12/2021 | Monden et al. |
| 2021/0371769 | A1 | 12/2021 | Monden et al. |
| 2022/0186136 | A1 | 6/2022 | Monden et al. |
| 2022/0220409 | A1 | 7/2022 | Monden et al. |

FOREIGN PATENT DOCUMENTS

| | | | |
|---|---|---|---|
| CN | 1441854 | A | 9/2003 |
| CN | 101155902 | A | 4/2008 |
| CN | 104762122 | A | 7/2015 |
| CN | 105523924 | A | 4/2016 |
| CN | 108865347 | A | 11/2018 |
| EP | 0544513 | A1 | 6/1993 |
| EP | 3702435 | A1 | 9/2020 |
| JP | 5-116922 | A | 5/1993 |
| JP | 5-254815 | A | 10/1993 |
| JP | 5-254989 | A | 10/1993 |

(Continued)

OTHER PUBLICATIONS

Office Action issued Dec. 21, 2022 in U.S. Appl. No. 17/605,282.

(Continued)

*Primary Examiner* — Taiwo Oladapo

(74) *Attorney, Agent, or Firm* — Sughrue Mion, PLLC

(57) ABSTRACT

This method for producing a lubricating oil composition includes: a step of dissolving fullerenes in a base oil mainly composed of a multiply alkylated cyclopentane oil or an ionic liquid containing an imide as a negative ion to obtain a fullerene solution; and a step of producing fullerenes adduct by subjecting the above-described fullerene solution to a heat treatment in a non-oxidizing atmosphere.

12 Claims, No Drawings

(56) References Cited

FOREIGN PATENT DOCUMENTS

| | | | | | |
|---|---|---|---|---|---|
| JP | 9-74216 | A | | 3/1997 | |
| JP | 10-140169 | A | | 5/1998 | |
| JP | 11-515053 | A | | 12/1999 | |
| JP | 2004-231739 | A | | 8/2004 | |
| JP | 2005-089667 | A | | 4/2005 | |
| JP | 2005-154755 | A | | 6/2005 | |
| JP | 2005-336309 | A | | 12/2005 | |
| JP | 2005336309 | A | * | 12/2005 | ..... B82Y 30/00 |
| JP | 2008-266501 | A | | 11/2008 | |
| JP | 2017-88757 | A | | 5/2017 | |
| KR | 10-2014-0103523 | A | | 8/2014 | |
| WO | 97/16510 | A1 | | 5/1997 | |
| WO | WO-9716510 | A1 | * | 5/1997 | ..... C10M 129/91 |
| WO | 2014/126315 | A1 | | 8/2014 | |
| WO | 2015/192075 | A1 | | 12/2015 | |
| WO | 2017/141825 | A1 | | 8/2017 | |
| WO | 2019/004275 | A1 | | 1/2019 | |
| WO | 2019-082917 | A1 | | 5/2019 | |

OTHER PUBLICATIONS

Office Action issued Dec. 21, 2022 in U.S. Appl. No. 17/605,320.
International Search Report for PCT/JP2020/017413, dated Jul. 21, 2020.
A. Nigam, et al., "Lattice-type Polymers from an Adduct of [60]Fullerene and 2-Methylaziridine", Journal of the Chemical Society—Chemical Communications, vol. 15, Dec. 31, 1995, pp. 1547-1548 (2 pages total).
Wenchao Guan et al., "Preliminary study on synthesis and lubrication mechanism of polyhydroxyfullerene derivatives", 1998 China Materials Seminar, Dec. 31, 1998, pp. 191-194 (4 pages total).
Xuefeng Li, et al., "Fabrication and atomic force microscopy/friction force microscopy (AFM/FFM) studies of polyacrylamide-carbon nanotubes (PAM-CNTs) copolymer thin films", Materials Chemistry and Physics, vol. 88, Issue 1, Dec. 31, 2004, pp. 53-58 (6 pages total).
Office Action dated Mar. 21, 2022 from the China National Intellectual Property Administration in CN Application No. 202080030347.4.
International Search Report for PCT/JP2020/017424, dated Jul. 21, 2020.
"Vacuum Technology—Vocabulary—Part 1:General terms", JIS Z8126-1:1999, 13 pages.
International Search Report for PCT/JP2020/017423, dated Jul. 14, 2020.
Office Action dated Mar. 22, 2022 issued by the China National Intellectual Property Administration in Chinese Application No. 202080030403.4.

* cited by examiner

METHOD FOR PRODUCING LUBRICATING OIL COMPOSITION, AND LUBRICATING OIL COMPOSITION

CROSS REFERENCE TO RELATED APPLICATIONS

This application is a National Stage of International Application No. PCT/JP2020/017423, filed Apr. 23, 2020, claiming priority to Japanese Patent Application No. 2019-083261, filed Apr. 24, 2019, the contents of all of which are incorporated herein by reference in their entirety.

TECHNICAL FIELD

The present invention relates to a method for producing a lubricating oil composition, and a lubricating oil composition.

BACKGROUND ART

Lubricating oil compositions that can be used under high vacuum are required to have properties different from those of ordinary lubricating oil compositions, such as a low vapor pressure and no substantial inclusion of volatile components.

Patent Literature 1 proposes a lubricant composition in which a perfluoroalkyl ether (PFAE), tris(2-octyldodecyl) cyclopentane, or the like having a low vapor pressure is used as a base oil.

Patent Literature 2 proposes an antistatic lubricating oil composition containing an antistatic substance selected from a lithium compound such as lithium bis(trifluoromethanesulfonyl) imide, and ionic liquids consisting of a nitrogen onium cation, and a weakly coordinating fluorine-containing organic anion or a weakly coordinating fluorine-containing inorganic anion.

Patent Literature 3 proposes a semi-solid lubricating oil composition consisting of an ionic liquid having a low vapor pressure and a conductivity preventing static electricity.

Patent Literature 4 proposes, as a lubricating oil composition having heat resistance and antioxidant properties, a lubricating oil composition containing (a) at least one base oil selected from the group consisting of an ionic liquid and a fluorine-free synthetic oil having a vapor pressure of $1\times10^{-4}$ Ton or less at 25° C. and (b) at least one selected from the group consisting of a fullerene compound and carbon particles by-produced in the production of a fullerene.

CITATION LIST

Patent Literature

[Patent Literature 1]
Japanese Unexamined Patent Application, First Publication No. H10-140169
[Patent Document 2]
Japanese Unexamined Patent Application, First Publication No. 2005-89667
[Patent Document 3]
Japanese Unexamined Patent Application, First Publication No. 2005-154755
[Patent Document 4]
Japanese Unexamined Patent Application, First Publication No. 2005-336309

Non-Patent Literature

[Non-Patent Literature 1]
JIS Z8126-1:1999 "Vacuum Technology-Vocabulary-Part 1:General terms"

SUMMARY OF INVENTION

Technical Problem

However, regarding all of these proposals, for example, in the use of a lubricating oil used in outer space, the lubricating oil compositions are placed in a harsh environment where they are exposed to high-energy rays such as cosmic rays under high vacuum. As a result, the physical properties of the lubricating oil composition change, and therefore it is insufficient to stably maintain the lubricating performance over a long period of time.

More specifically, the change in physical properties of a lubricating oil composition occurs because molecules of a base oil constituting the lubricating oil composition are gradually cleaved and molecular chains of the base oil are shortened. In particular, in a lubricating oil composition used under high vacuum, an increase in vapor pressure of the lubricating oil composition due to production of components having a small molecular weight causes various problems as described below. The series of changes of a base oil is called "deterioration of a base oil." The deterioration of a base oil may be caused not only by high-energy rays but also by heat generation due to frictional wear in a case where extreme force is applied to a sliding portion.

The increase in vapor pressure due to deterioration of a base oil can also cause wear in the sliding portion and seizure since some of the base oil evaporates and is lost during use and the amount of lubricating oil decreases from the sliding portion. In addition, when some of the base oil evaporates, a lubricating oil also scatters and adheres to a portion other than a sliding portion of a mechanical device, thereby contaminating the mechanical device.

An object of the present invention is to provide a lubricating oil composition and a method for producing a lubricating oil composition in which excellent abrasion resistance can be exhibited, an increase in vapor pressure due to deterioration of a base oil can be suppressed, and lubricating performance can be stably maintained over a longer period of time even under vacuum.

Solution to Problem

The present inventors have found that, in a case where there is fullerenes in a base oil mainly composed of a multiply alkylated cyclopentane oil (hereinafter, sometimes referred to as a "MAC oil") or an ionic liquid containing an imide as a negative ion (hereinafter, sometimes referred to as an "imide-based ionic liquid"), cleaved molecules, some of which constitute the above-described base oil , react with the fullerene to form fullerene adducts. Accordingly, firstly, the above-described cleaved molecules having low molecular weights are captured by the fullerene without remaining as they are, and therefore an increase in vapor pressure of a lubricating oil composition is suppressed. Furthermore, secondly, since the fullerene adducts produced due to the reaction between the fullerene and the above-described cleaved molecules have a part of a molecular structure of the base oil, affinity with the above-described base oil becomes higher than that of the original fullerene. Therefore, fullerene aggregates are less likely to precipitate, and the stability of the lubricating oil composition improves.

That is, the present invention provides the following means to solve the above-described problems.

[1] A method for producing a lubricating oil composition, including: a step of dissolving fullerenes in a base oil mainly composed of a multiply alkylated cyclopentane oil or an ionic liquid containing an imide as a negative ion configured to obtain a fullerene solution; and a step of producing fullerene adducts by subjecting the fullerene solution to a heat treatment in a non-oxidizing atmosphere.

[2] The method for producing a lubricating oil composition according to [1], in which an oxygen gas partial pressure in the non-oxidizing atmosphere is less than or equal to 10 pascals.

[3] The method for producing a lubricating oil composition according to [1] or [2], in which a temperature of the heat treatment is 80° C. to 300° C.

[4] The method for producing a lubricating oil composition according to any one of [1] to [3], in which the heat treatment is performed until a concentration of fullerenes in the fullerene solution is 0.1 to 0.7 with respect to a concentration of fullerenes before the heat treatment.

[5] The method for producing a lubricating oil composition according to any one of [1] to [4], in which the fullerene dissolved in the base oil is $C_{60}$ or $C_{70}$ or a mixture thereof.

[6] The lubricating oil composition including: a base oil mainly composed of a multiply alkylated cyclopentane oil or an ionic liquid containing an imide as a negative ion; and fullerene adducts obtained by adding a component derived from the base oil to fullerenes.

[7] The method for producing a lubricating oil composition according to [1], in which a temperature of the heat treatment in the step of producing fullerene adducts is higher than or equal to an upper limit usage temperature of the base oil, and the difference between the temperature of the heat treatment and the upper limit usage temperature is within 200° C.

[8] The method for producing a lubricating oil composition according to any one of [1] to [5] and [7], the method further including: a step of removing an insoluble component using a membrane filter or a centrifugal separator after performing the step of obtaining the fullerene solution.

[9] The method for producing a lubricating oil composition according to any one of [1] to [5], [7], and [8], in which a heat treatment time in the step of producing fullerene adducts is 5 minutes to 24 hours.

[10] The method for producing a lubricating oil composition according to any one of [1] to [5] and [7] to [9], in which the concentration of the fullerene in the fullerene solution is 1 mass ppm (0.0001 mass %) to 1,000 mass ppm (0.1 mass %).

[11] The method for producing a lubricating oil composition according to any one of [1] to [5] and [7] to [10], the method further including: an adjustment step of reducing a concentration of oxygen molecules before the step of producing fullerene adducts, in which the adjustment step and the step of producing fullerene adducts are continuously performed, and in the adjustment step, the fullerene solution is placed into an airtight metal container and the inside of the metal container is substituted with an inert gas.

[12] The method for producing a lubricating oil composition according to any one of [1] to [5] and [7] to [10], the method further including: an adjustment step of reducing a concentration of oxygen molecules before the step of producing fullerene adducts, in which the adjustment step and the step of producing fullerene adducts are continuously performed, and in the adjustment step, the fullerene solution is placed into an airtight metal container and the inside of the metal container is decompressed.

Advantageous Effects of Invention

According to the present invention, it is possible to provide a lubricating oil composition and a method for producing a lubricating oil composition in which excellent abrasion resistance can be exhibited, an increase in vapor pressure due to deterioration of a base oil can be suppressed, and lubricating performance can be stably maintained over a longer period of time even under vacuum.

DESCRIPTION OF EMBODIMENTS

Hereinafter, a lubricating oil composition and a method for producing the same will be described according to a preferred embodiment of the present invention. The present embodiment is specifically described to facilitate better understanding of the gist of the invention, and does not limit the present invention unless otherwise specified. For example, numbers, numerical values, positions, materials, shapes, or proportions can be modified, added, and omitted within the scope not departing from the invention.

Lubricating Oil Composition

The lubricating oil composition according to the present embodiment includes: a base oil mainly composed of a multiply alkylated cyclopentane oil or an ionic liquid containing an imide as a negative ion (hereinafter, sometimes simply referred to as a "base oil"); and fullerene adducts obtained by adding a component derived from the base oil to fullerenes.

(Fullerenes)

The fullerene used as a raw material of the lubricating oil composition of the present embodiment is not particularly limited in its structure or production method, and various fullerenes can be used. Examples of fullerenes include $C_{60}$ and $C_{70}$, which are relatively easily available, a high-order fullerene, and a mixture thereof. Among these, $C_{60}$ and $C_{70}$ are preferable from the viewpoint of high solubility in lubricating oils. In a case of a mixture of fullerenes, the content of $C_{60}$ with respect to the total content of fullerenes constituting the mixture is preferably greater than or equal to 50 mass %.

(Base Oil)

In the present embodiment, the main component of the base oil of the lubricating oil composition is a multiply alkylated cyclopentane oil or an ionic liquid containing an imide as a negative ion. In general, such a base oil has a small amount of volatile components, and therefore is preferable as a base oil of a lubricating oil composition used under vacuum. For example, according to Non-Patent Literature 1, the vacuum is a state of a space filled with a gas having a pressure lower than normal atmospheric pressure, and under high vacuum means, for example, under a pressure of $10^{-5}$ pascals to $10^{-1}$ pascals. In the expression "the main component of the base oil is a multiply alkylated cyclopentane oil or an ionic liquid containing an imide as a negative ion," it is sufficient as long as inevitable impurities can be avoided. For example, the expression means that the content of a multiply alkylated cyclopentane oil or an ionic liquid containing an imide as a negative ion is greater than or equal to 50 mass %, greater than or equal to 60 mass %, greater than or equal to 70 mass %, greater than or equal to 80 mass %, greater than or equal to 90 mass %, or greater than or equal to 95 mass %. The upper limit value is not particularly limited and is less than or equal to 100 mass %.

Examples of nonvolatile base oils contained in the lubricating oil composition according to the present embodiment include multiply-alkylated cyclopentane-based or imide-based ionic liquids.

In a multiply-alkylated cyclopentane, a plurality of alkyl groups bind to a cyclopentane ring. The above-described alkyl groups preferably have a total carbon number of 48 to 112, and each alkyl group may be the same or they may be different from each other. Specific examples thereof include tris(2-octyldodecyl) cyclopentane and tetra(dodecyl) cyclopentane.

As an imide-based ionic liquid, an ionic compound which contains a cation part and an anion part composed of imide-based ions and is liquid state at room temperature to 80° C. is preferable because it is easy to handle.

Specific examples of anion parts include bis(trifluoromethanesulfonyl)imide, bis(fluorosulfonyl)imide, and diethyl phosphate.

In addition, examples of cations include lithium cation, cyclohexyltrimethylammonium, ethyl(dimethyl)(phenylethyl)ammonium, methyltrioctylammonium, 1-aryl-3-methylimidazolium, 1-ethyl-3-methylimidazolium, 1-butyl-3-methylimidazolium, 1-hexyl-3-methylimidazolium, 1-butyl-2,3-diethylimidazolium, 3, 3'-(butane-1,4-diyl) bis (1-vinyl-3-imidazolium), 1-decyl-3-methylimidazolium, 1-butyl-4-methylpyridinium, 4-ethyl-4-methylmorpholinium, tetrabutylphosphonium, tributyl(2-methoxyethyl) phosphonium, trihexyl(tetradecyl)phosphonium, 1-butyl-1-methylpiperidinium, 1-butylpyridinium, 1-butylmethylpyrrolidinium, and tributylsulfonium.

More specific examples of ionic liquids include compounds obtained by combining such compounds of cationic parts and compounds of anionic parts. The compounds of cationic parts and the compounds of anionic parts to be combined may or may not each be of a single kind.

The base oil used in the present embodiment has a vapor pressure at 25° C. of preferably 1 pascal or less, more preferably 0.1 pascals or less, and still more preferably 0.01 pascals or less.

(Additives)

In the step of producing a lubricating oil composition of the present embodiment, additives may be added to the lubricating oil composition within a range not impairing the effect as the lubricating oil composition. Additives to be added to the lubricating oil composition of the present embodiment are not particularly limited as long as they are nonvolatile additives. Examples of such additives include antioxidants, viscosity index improvers, extreme pressure additives, detergent dispersants, pour point depressants, corrosion inhibitors, solid lubricants, oiliness improvers, rust preventive additives, anti-emulsifiers, antifoaming agents, and hydrolysis inhibitors which are commercially available. Such additives may be used alone or in a combination of two or more thereof.

Examples of antioxidants include butylhydroxyanisole (BHA) and dialkyldiphenylamines.

Examples of viscosity index improvers include polyalkylstyrenes or hydrogenated styrene-diene copolymers.

Examples of extreme pressure additives include dibenzyl disulfide, an allyl phosphate ester, an allyl phosphite ester, an amine salt of an allyl phosphate ester, an allyl thiophosphate ester, and an amine salt of an allyl thiophosphate ester.

Examples of detergent dispersants include benzylamine, succinic acid derivatives, and alkylphenol amines.

Examples of pour point depressants include chlorinated paraffin-naphthalene condensates, chlorinated paraffin-phenol condensates, and polyalkyl styrene-based pour point depressants.

Examples of anti-emulsifiers include alkylbenzene sulfonates.

Examples of corrosion inhibitors include dialkylnaphthalene sulfonates.

(Method for Producing Lubricating Oil Composition)

The method for producing a lubricating oil composition according to the present embodiment includes: a dissolution step of dissolving fullerenes in a base oil mainly composed of a multiply alkylated cyclopentane oil or an ionic liquid containing an imide as a negative ion to obtain a fullerene solution; and a heat treatment step of producing fullerene adducts by subjecting the above-described fullerene solution to a heat treatment in a non-oxidizing atmosphere. An addition step of adding an additive to the above-described fullerene solution may be further provided as necessary.

(1) Step of Obtaining Fullerene Solution

The fullerene solution used in the present embodiment can be obtained by, for example, mixing fullerenes with a MAC oil.

The concentration of the fullerene in the fullerene solution is more preferably 1 mass ppm (0.0001 mass %) to 1,000 mass ppm (0.1 mass %) and still more preferably 5 mass ppm (0.0005 mass %) to 100 mass ppm (0.01 mass %). Within these ranges, the fullerene can be easily dissolved and an effect as a lubricating oil composition can be easily obtained.

As a method for mixing fullerenes with a MAC oil, it is preferable to perform the mixing while stirring. Specifically, when stirring, usual mechanical stirring, ultrasonication, or the like is performed. In a case where a base oil (MAC oil) is a low-viscosity liquid at room temperature, the base oil can be stirred at room temperature. On the other hand, in a case where a base oil is a high-viscosity liquid or solid at room temperature, the base oil can be stirred by turning into a low-viscosity liquid through heating.

In a case where an insoluble component remains in a fullerene solution produced through mixing fullerenes with a MAC oil or a case where there is a concern that an insoluble component may remain in the fullerene solution, it is preferable that a removal step of removing the insoluble component from the produced fullerene solution be further included. Examples of methods for removing an insoluble component from a fullerene solution include a method for removing an insoluble component through filtration with a membrane filter, a method for precipitating and removing an insoluble component with centrifugation, and a method for removing an insoluble component by combining these methods. By removing an insoluble component, a high-quality lubricating oil composition capable of further reducing wear of a sliding portion or the like can be obtained.

(2) Heat Treatment Step

In the present embodiment, the above-described fullerene solution is heat-treated in a non-oxidizing atmosphere. It is thought that, due to this heat treatment, highly reactive low-molecular-weight molecules which constitute a base oil and some bonds of which are cleaved (hereinafter, sometimes simply referred to as "cleaved molecules") are produced, and the cleaved molecules are added to fullerenes to produce fullerene adducts.

The fullerene adducts produced in this manner have a part of the molecular structure of the base oil. For this reason, it is thought that the fullerene adducts have a high affinity with the base oil and solubility of the fullerene adducts is superior to the fullerene. For this reason, precipitation of fullerene aggregates or the like in an obtained lubricating oil composition is unlikely to occur. That is, the stability of a lubricating oil composition improves.

It is preferable that the above-described heat treatment be performed in a non-oxidizing atmosphere and that oxygen molecules in the fullerene solution be removed before the heat treatment. Specific examples of the above-described non-oxidizing atmosphere include an atmosphere of an inert gas such as nitrogen. In a gas phase in equilibrium with the fullerene solution, the oxygen gas partial pressure in the above-described non-oxidizing atmosphere is preferably 10 pascals or less, more preferably 2 pascals or less, and still more preferably 0.2 pascals or less.

In a case where the heat treatment is not performed in a non-oxidizing atmosphere, cleaved molecules that are produced sometimes react with oxygen molecules and do not sufficiently react with the fullerene. If the cleaved molecules are not captured by the fullerene, there is a concern that lubrication characteristics may be impaired, for example, a vapor pressure of a lubricating oil composition may increase.

Since the temperature and time of a heat treatment vary depending on the type of base oil used as a raw material, they may be appropriately changed according to the type of base oil. In a case where the upper limit usage temperature is known from the specifications of a base oil or the like, a standard of the temperature of a heat treatment is within a range from the upper limit usage temperature to the upper limit usage temperature +200° C. Within this temperature range, molecular chains of a base oil are moderately cleaved and cleaved molecules are effectively produced, whereby fullerene adducts are easily obtained. A standard of the heat treatment temperature in a case where the upper limit usage temperature is unclear, the temperature of the above-described heat treatment is preferably 80° C. to 300° C., more preferably 100° C. to 250° C., and still more preferably 120° C. to 200° C. Even in a case where the upper limit usage temperature of a base oil is known, the temperature ranges may be used as a standard of a heat treatment temperature.

In addition, the heat treatment time for obtaining an appropriate amount of fullerene adducts is preferably adjusted to 5 minutes to 24 hours, more preferably adjusted to 5 minutes to 12 hours, and still more preferably adjusted to 5 minutes to 6 hours from the viewpoint of ease of operation. If the heat treatment temperature is raised, the heat treatment time can be shortened, and conversely, if the heat treatment temperature is lowered, the heat treatment time can be prolonged. Alternatively, it is still more preferable to determine the heat treatment conditions based on the residual amount of the fullerene to be described below.

Since a fullerene solution is usually handled in atmospheric air, the concentration of oxygen in the fullerene solution is in equilibrium with oxygen in atmospheric air. Therefore, it is preferable to perform a heat treatment in a non-oxidizing atmosphere and provide an adjustment step of reducing the concentration of oxygen molecules in the fullerene solution before the heat treatment step.

It is more preferable to perform the heat treatment step consecutive to the above-described adjustment step of reducing the concentration of oxygen molecules. Examples of such methods include the following two methods. The present embodiment is not limited to the examples.

A first method will be described. After a fullerene solution is taken into an airtight container made of a metal such as stainless steel, the container is sealed. Subsequently, the inside of the container is substituted with an inert gas such as nitrogen gas or argon gas. Preferably in addition the fullerene solution in the container is further bubbled with the inert gas to create equilibrium state between the fullerene solution and the inert gas. Subsequently, the container is heated (heat treatment) while the equilibrium state between the fullerene solution and the inert gas is maintained. Accordingly, the fullerene solution is heat-treated in a non-oxidizing atmosphere. The above-described inert gas preferably contains as little oxygen gas as possible as an impurity so that the oxygen gas partial pressure when the inside of the above-described container is substituted with an inert gas can be reduced to 10 pascals or less.

A second method will be described. After a fullerene solution is taken into an airtight container made of a metal such as stainless steel, the container is sealed. Subsequently, the container is decompressed to reduce the concentration of oxygen in the fullerene solution. The fullerene solution is heat-treated by heating the container while maintaining the decompression condition. In this method, when the pressure during decompression is configured to be 10 pascals or less, the oxygen gas partial pressure in a gas phase is also 10 pascals or less and is usually 2 pascals or less.

By performing the heat treatment in this manner, a lubricating oil composition containing a base oil and fullerene adducts obtained by adding a component derived from the above-described base oil to fullerenes can be obtained. The concentration of the fullerene in the obtained lubricating oil composition is lower than that of fullerene in the fullerene solution before the heat treatment. The reason why the concentration decreases in this manner is because some fullerenes react with cleaved molecules of a base oil and are changed into fullerene adducts.

In the above-described heat treatment, the amount of fullerene adducts produced is preferably controlled to a certain amount. However, since the fullerene adducts are a mixture of various chemical species, the concentration of residual fullerene which is easier to quantitatively determine may be controlled to a certain range. Specifically, it is preferable that the concentration of fullerenes in a fullerene solution before and after a heat treatment be measured and the reduction rate (hereinafter, sometimes referred to as a "fullerene residual ratio") be within a certain range.

Regarding a method for measuring the concentration of fullerenes, the concentration thereof is measured through a technique using high-performance liquid chromatography (HPLC) described in examples. More specifically, the concentration thereof can be calculated from the following.

(Fullerene residual ratio)=[concentration of fullerene after heat treatment]/[concentration of fullerene before heat treatment]

In order to obtain a fullerene residual ratio in the middle of a heat treatment, the "concentration of fullerene after heat treatment" in the above-described equation may be replaced with "concentration of fullerene during heat treatment".

The higher the fullerene residual ratio, the more cleaved molecules produced during use of a lubricating oil composition tend to be captured.

On the other hand, the lower the fullerene residual ratio, he more stable lubricating oil composition can be obtained and the more the fullerene aggregates tend to be suppressed from precipitating during use of the lubricating oil composition. However, since fullerenes react with cleaved molecules to some extent, the amount of cleaved molecules which are newly produced during use of the lubricating oil composition and can be captured is slightly reduced. It is noted that, since one fullerene molecule can capture several cleaved molecules, it is possible to capture cleaved molecules even if the fullerene residual ratio is 0. Accordingly, the lubricating oil composition may contain no fullerene.

In general, the fullerene residual ratio is preferably 0.1 to 0.7 and more preferably 0.2 to 0.5. Accordingly, in the present embodiment, the above-described heat treatment is preferably performed until the concentration of the unreacted fullerene in the solution is 0.1 times to 0.7 times with respect to the concentration of the unreacted fullerene before the above-described heat treatment. It is noted that, the fullerene residual ratio is particularly preferably set according to the purpose of use and the usage environment of the lubricating oil composition. For example, in an environment exposed to cosmic rays with high frequency, the fullerene residual ratio can be set high by giving priority to the capture of cleaved molecules. Alternatively, for the purpose of long-term use, the fullerene residual ratio can be set low by giving priority to stability of the lubricating oil composition.

Examples of methods for obtaining a lubricating oil composition having a specific fullerene residual ratio include a method in which a target fullerene residual ratio is determined in advance, heat treatment is performed while measuring the fullerene residual ratio, and the heat treatment is finished at a point in time when it is expected that the residual rate will reach a target value through extrapolating from the measurement results of several points.

The change of fullerenes to fullerene adducts can be confirmed through mass spectrum measurement of a lubricating oil composition. For example, in a case where $C_{60}$ is used as fullerenes, only of m/z=720 corresponding to $C_{60}$ is confirmed in a fullerene solution before a heat treatment. On the other hand, in a lubricating oil composition obtained after a heat treatment, the peak of 720 is reduced, and a plurality of peaks of fullerene adducts appear. As the main peak, a peak (722+2N) corresponding to Coo to which alkyl radicals produced through cleavage of a MAC oil are added can be confirmed. N is a natural number of 60 or less.

The lubricating oil composition produced through the above-described method includes: a base oil mainly composed of a multiply alkylated cyclopentane oil or a base oil mainly composed of an ionic liquid containing an imide as a negative ion; and fullerene adducts obtained by adding a component derived from the base oil to fullerenes.

According to the lubricating oil composition of the present embodiment, not only is the frictional resistance reduced and the abrasion resistance excellent, but also production of volatile components due to deterioration of a base oil can be suppressed and an increase in vapor pressure of the lubricating oil composition can be suppressed. The lubricating oil composition of the present embodiment can be used in various applications, but is particularly suitable for use in vacuum or in outer space.

Although the preferred embodiment of the present invention has been described in detail above, the present invention is not limited to a specific embodiment and various modifications and changes can be made within the scope of the gist of the present invention disclosed in the claims.

EXAMPLES

Hereinafter, examples of the present invention will be described. The present invention is not limited to the following examples.

Example 1

(Preparation of Lubricating Oil Composition)

0.001 g of a fullerene raw material (manufactured by Frontier Carbon Corporation, Nanom™ Purple ST $C_{60}$) and 10 g of tris(2-octyldodecyl) cyclopentane (manufactured by Nye Lubricants, Synthetic Oil 2001A) which is a MAC oil as a base oil A were mixed with each other and stirred for 36 hours using a stirrer at room temperature. The obtained mixture was filtered with a 0.1 μm mesh membrane filter, and the obtained filtrate was used as a fullerene solution. The concentration of the fullerene in the fullerene solution was 100 ppm.

Next, the fullerene solution was placed into a 25 mL eggplant flask and covered with a three-way cock. Next, the three-way cock was opened, an injection needle was inserted thereinto, and nitrogen gas having a purity of 99.99 volume % (the partial pressure of gases other than nitrogen at normal pressure is 10 pascals or less) was allowed to flow at 60 mL/min for 10 minutes. Next, the three-way cock was closed and the eggplant flask was filled with nitrogen gas. That is, the eggplant flask was filled with nitrogen gas.

Next, about 0.01 mL of the fullerene solution was sampled from the inside of the eggplant flask every 5 minutes using an injector while heat-treating the fullerene solution by immersing the eggplant flask in an oil bath at 120° C., and the concentration of the fullerene was measured through high-performance liquid chromatography (HPLC) to calculate the fullerene residual ratio. 15 minutes after the start of the measurement, the fullerene residual ratio became 0.2, and therefore, the eggplant flask was taken out of the oil bath and cooled to room temperature to obtain a lubricating oil composition. The concentration of the fullerene in the lubricating oil composition was measured, and the result was 15 ppm. Therefore, the fullerene residual ratio was found to be 0.15.

Regarding the above-described measurement of the concentration of the fullerene, the concentration thereof was detected at an absorbance (wavelength of 309 nm) using a high-performance liquid chromatograph (manufactured by Agilent Technologies, 1200 series), a column YMC-Pack ODS-AM (150 mm×4.6) manufactured by YMC CO., LTD., and a 1:1 (volume ratio) mixture of toluene and methanol as a development solvent to quantitatively determine the amount of fullerene in a sample such as a lubricating oil composition. In addition, a calibration curve was created from the above-described fullerene raw material.

In addition, the obtained lubricating oil composition and the fullerene solution before a heat treatment were subjected to a component analysis with a molecular weight of 720 to 2,000 using a mass spectrometer (manufactured by Agilent Technologies, LC/MS, 6120). As a result, in the lubricating oil composition, signal intensity peaks of m/z=750, 764, 766, 778, 780, 792, 794, 796, 808, 806, 820, and 834 were newly confirmed compared to the fullerene solution (with a main peak of 720) before a heat treatment. From this, it was confirmed that the lubricating oil composition contained fullerene adducts.

(Evaluation of Abrasion Resistance)

The abrasion resistance of the obtained lubricating oil composition was evaluated using friction test (manufactured by Anton Paar, Ball-On-Disc Tribometer).

First, the material of a substrate and a ball was a high carbon chromium bearing steel material SUJ2, and the diameter of the ball was 6 mm. The lubricating oil composition was applied to one main surface of the substrate, and the substrate was heated to 100° C. Next, the ball was slid on the one main surface of the substrate via the lubricating oil composition so that the ball drew a concentric orbit. The sliding speed of the ball on the one main surface of the substrate was set to 15 cm/sec, and the load of the ball on the one main surface of the substrate was set to 20 N. The worn area on the ball surface when the sliding distance of the ball on the one main surface of the substrate was 400 m in total was observed with an optical microscope, the diameter of the worn area was measured, and the numerical value was regarded as an abrasion resistance. It can be said that the smaller the diameter of the worn area, the better the abrasion resistance. The results are shown in Table 1.

(Evaluation of Stability)

Components volatilized from the lubricating oil composition under high vacuum were measured using a temperature-programmed desorption gas analyzer (manufactured by Rigaku Corporation, TPD type V). The amount of desorbed gas of 0.02 g of the lubricating oil composition was measured at an atmospheric pressure of $10^{-4}$ pascals. In order to eliminate the influence of molecules having a molecular weight smaller than that of carbonic dioxide gas (molecular weight of 44), an integrated value of peaks of molecular weights of 46 to 200 was obtained as an amount of desorbed gas.

An integrated value of signal intensity due to trimethylbenzene (TMB) (manufactured by Tokyo Chemical Industry Co., Ltd.) was regarded as 1 (reference value), in a case where the measurement was performed in the same manner described above on a sample obtained by adding TMB as a volatile component to the base oil A so that the content of TMB was 1 mass ppm. And a ratio of an integrated value of peaks of signal intensity due to the above-described desorbed gas from the lubricating oil composition to the reference value was obtained as a degree of desorbed gas. It can be said that the smaller the degree of desorbed gas, the better the stability under high vacuum. The degree of desorbed gas was measured at two points, one before an abrasion resistance test of the lubricating oil composition and the other after the abrasion resistance test thereof. The results are shown in Table 1.

Comparative Example 1

A lubricating oil composition was obtained in the same manner as in Example 1 except that the above-described fullerene solution was not heated. The obtained lubricating oil composition was subjected to a component analysis with a molecular weight of 720 to 2,000 using a mass spectrometer (manufactured by Agilent Technologies, LC/MS, 6120). As a result, the peak of a fullerene adduct could not be detected, and it was confirmed that there was no fullerene adduct in the lubricating oil composition of Comparative Example 1. The results of the degree of desorbed gas and the abrasion resistance of the obtained lubricating oil composition are shown in Table 1.

Comparative Example 2

A lubricating oil composition was obtained in the same manner as in Example 1 except that fullerenes were not added to the base oil A and the base oil A was not heated. That is, the obtained lubricating oil composition was composed of only the base oil A in Comparative Example 2. The results of the degree of desorbed gas and the abrasion resistance of the obtained lubricating oil composition are shown in Table 1.

TABLE 1

| | | | | Degree of desorbed gas of lubricating oil composition | |
|---|---|---|---|---|---|
| | Composition of lubricating oil composition | Heat treatment | Diameter [μm] of rubbing surface | Before abrasion resistance test [−] | After abrasion resistance test [−] |
| Example 1 | Base oil A + FLN | Nitrogen | 175 | 0.4 | 0.9 |
| Comparative Example 1 | Base oil A + FLN | None | 210 | 0.4 | 1.5 |
| Comparative Example 2 | Base oil A | None | 240 | 0.1 | 2.1 |
| Example 2 | Base oil B + FLN | Nitrogen | 270 | 0.2 | 0.6 |
| Comparative Example 3 | Base oil B + FLN | None | 330 | 0.2 | 1.1 |
| Comparative Example 4 | Base oil B | None | 360 | 0.1 | 1.3 |
| Example 3 | Base oil A + FLN | 120° C., Vacuum | 175 | 0.2 | 0.7 |
| Example 4 | Base oil A + FLN | Nitrogen + 1% oxygen | 180 | 0.4 | 1.1 |
| Example 5 | Base oil A + FLN | Air | 200 | 0.4 | 1.3 |
| Example 6 | Base oil A + FLN | 85° C., Vacuum | 190 | 0.2 | 0.8 |
| Example 7 | Base oil A + FLN | 105° C., Vacuum | 185 | 0.2 | 0.8 |
| Example 8 | Base oil A + FLN | 210° C., Vacuum | 185 | 0.2 | 0.8 |
| Example 9 | Base oil A + FLN | 260° C., Vacuum | 200 | 0.2 | 1 |
| Example 10 | Base oil C + FLN | Nitrogen | 275 | 0.2 | 0.6 |
| Comparative Example 5 | Base oil C + FLN | None | 340 | 0.2 | 1.2 |

As shown in Table 1, in Example 1, when the fullerene solution was obtained by adding fullerenes to a base oil A and was heat-treated in a nitrogen atmosphere, the diameter of the worn area was 175 μm, and the degassing degrees of the lubricating oil composition before and after the abrasion resistance test were respectively 0.4 and 0.9. Therefore, it was found that the abrasion resistance and the stability under high vacuum in Example 1 were excellent.

On the other hand, in Comparative Example 1, when the above-described fullerene solution was not heat-treated, the diameter of the worn area was 210 and the abrasion resistance was inferior to that of Example 1. In addition, the degassing degrees of the lubricating oil composition before and after the abrasion resistance test were respectively 0.4 and 1.5, and the stability under high vacuum after the abrasion resistance test was inferior to that of Example 1.

In addition, in Comparative Example 2, when no fullerene was added to a base oil A and the base oil A was not heat-treated, the diameter of the worn area was 240 μm, and the abrasion resistance was greatly inferior to that of Example 1. In addition, the degassing degrees of the lubricating oil composition before and after the abrasion resistance test were respectively 0.1 and 2.1, and the stability under high vacuum after the abrasion resistance test was greatly inferior to that of Example 1.

Example 2

A lubricating oil composition was obtained in the same manner as in Example 1 except that 1-decyl-3-methyl-imidazolium-bis(trifluoromethanesulfonyl) imide (manufactured by Tokyo Chemical Industry Co., Ltd.), which is an imide-based ionic liquid, was used as a base oil B. The obtained lubricating oil composition was subjected to a component analysis with a molecular weight of 720 to 2,000 using a mass spectrometer, and as a result, it was confirmed that there was fullerene adducts. The results of the degree of desorbed gas and the abrasion resistance of the obtained lubricating oil composition are shown in Table 1.

Comparative Example 3

A lubricating oil composition was obtained in the same manner as in Example 2 except that the fullerene solution was not heated. The obtained lubricating oil composition was subjected to a component analysis with a molecular weight of 720 to 2,000 using a mass spectrometer, and as a result, it was confirmed that no fullerene adduct is found. The results of the degree of desorbed gas and the abrasion resistance of the obtained lubricating oil composition are shown in Table 1.

Comparative Example 4

A lubricating oil composition was obtained in the same manner as in Example 2 except that fullerenes were not added to the above-described base oil B and the above-described base oil B was not heated. That is, the obtained lubricating oil composition was composed of only the base oil B in Comparative Example 4. The results of the degree of desorbed gas and the abrasion resistance of the obtained lubricating oil composition are shown in Table 1.

In Example 2, when the fullerene solution was obtained by adding fullerenes to a base oil B and was heat-treated in a nitrogen atmosphere, the diameter of the worn area was 270 μm. On the other hand, the diameter of the worn area in Comparative Example 3 where heat treatment was not performed was 330 μm, and the diameter of the worn area in Comparative Example 4 where no fullerene was added was 360 μm. In addition, the degassing degrees of the lubricating oil composition before and after the abrasion resistance test were respectively 0.2 and 0.6 in Example 2, 0.2 and 1.1 in Comparative Example 3, and 0.1 and 1.3 in Comparative Example 4. Comparing the results of Example 2, Comparative Example 3, and Comparative Example 4, the results showed that both the abrasion resistance and the degree of desorbed gas were favorable in a case where fullerenes were added to a base oil B and heating was performed, but both the abrasion resistance and the degree of desorbed gas were inferior in a case where no heat treatment was performed or in a case where only a base oil B was incorporated. This showed that the base oil B, which is an ionic liquid, also has the same tendency as that of the base oil A which was a MAC oil.

Example 3

A lubricating oil composition was obtained in the same manner as in Example 1 except that oxygen contained in the fullerene solution was removed by bringing the eggplant flask into a vacuum state with a vacuum pump instead of filling the eggplant flask with nitrogen gas. The results of the degree of desorbed gas and the abrasion resistance of the obtained lubricating oil composition are shown in Table 1.

Example 4

A lubricating oil composition was obtained in the same manner as in Example 1 except that nitrogen gas containing 1 volume% of oxygen gas was allowed to flow instead of filling the eggplant flask with nitrogen gas. The results of the degree of desorbed gas and the abrasion resistance of the obtained lubricating oil composition are shown in Table 1.

Example 5

A lubricating oil composition was obtained in the same manner as in Example 1 except that air was allowed to flow instead of filling the eggplant flask with nitrogen gas.

The results of the degree of desorbed gas and the abrasion resistance of the obtained lubricating oil composition are shown in Table 1.

The diameter of the worn area was 175 μm in Example 3, 180 μm in Example 4, and 200 μm in Example 5. In addition, the degassing degrees of the lubricating oil composition before and after the abrasion resistance test were respectively 0.2 and 0.7 in Example 3, 0.4 and 1.1 in Example 4, and 0.4 and 1.3 in Example 5. Comparing the results of Examples 1 and 3 to 5, it was found that the lower the concentration of oxygen gas in the heat treatment step, the better the abrasion resistance and the degassing degree.

Example 6

A lubricating oil composition was obtained in the same manner as in Example 3 except that the fullerene solution was heat-treated at 85° C. The results of the degree of desorbed gas and the abrasion resistance of the obtained lubricating oil composition are shown in Table 1.

Example 7

A lubricating oil composition was obtained in the same manner as in Example 3 except that the fullerene solution was heat-treated at 105° C. The results of the degree of desorbed gas and the abrasion resistance of the obtained lubricating oil composition are shown in Table 1.

Example 8

A lubricating oil composition was obtained in the same manner as in Example 3 except that the fullerene solution was heat-treated at 210° C. The results of the degree of desorbed gas and the abrasion resistance of the obtained lubricating oil composition are shown in Table 1.

Example 9

A lubricating oil composition was obtained in the same manner as in Example 3 except that the fullerene solution was heat-treated at 260° C. The results of the degree of desorbed gas and the abrasion resistance of the obtained lubricating oil composition are shown in Table 1.

The diameter of the worn area was 190 μm in Example 6, 185 μm in Examples 7 and 8, and 200 μm in Example 9. In addition, the degassing degrees of the lubricating oil composition before and after the abrasion resistance test were respectively 0.2 and 0.8 in Examples 6 to 8 and 0.2 and 1.0 in Example 9. Comparing the results of Examples 3 and 6 to 9, the improvement in abrasion resistance was best when the heat treatment temperature was 120° C., then 105° C. and 210° C., then 85° C., and then 260° C.

Example 10

A lubricating oil composition was obtained in the same manner as in Example 1 except that 1-butyl-4-methylpyridinium-bis(fluorosulfonyl) imide, referred to as base oil C, which is an imide-based ionic liquid, was used as a base oil. The obtained lubricating oil composition was subjected to a component analysis with a molecular weight of 720 to 2,000 using a mass spectrometer, and as a result, it was confirmed that there were fullerene adducts. The results of the degree of desorbed gas and the abrasion resistance of the obtained lubricating oil composition are shown in Table 1.

Comparative Example 5

A lubricating oil composition was obtained in the same manner as in Example 10 except that the fullerene solution was not heat-treated. The obtained lubricating oil composition was subjected to a component analysis with a molecular weight of 720 to 2,000 using a mass spectrometer, and as a result, it was confirmed that there was no fullerene adduct. The results of the degree of desorbed gas and the abrasion resistance of the obtained lubricating oil composition are shown in Table 1.

The diameter of the worn area was 275 μm in Example 10 and 340 μm in Comparative Example 5. In addition, the degassing degrees of the lubricating oil composition before and after the abrasion resistance test were respectively 0.2 and 0.6 in Example 10 and 0.2 and 1.2 in Comparative Example 5. Comparing the results of Example 10 and Comparative Example 5, the results showed that both the abrasion resistance and the degree of desorbed gas were favorable in a case where fullerenes were added to a base oil C and heating was performed, but both the abrasion resistance and the degree of desorbed gas were inferior in a case where no heating was performed. This showed that the base oil C also has the same tendency as that of the base oil A or the base oil B.

INDUSTRIAL APPLICABILITY

The lubricating oil composition of the present invention is useful for devices and equipment used in high altitude regions or outer space, or under high vacuum, and is significantly useful for long-term suppression of damage or abrasion of metal parts under vacuum in, for example, sliding portions of devices or equipment mounted on aircraft, spacecrafts, rockets, probes, space stations, and satellites.

The invention claimed is:

1. A method for producing a lubricating oil composition, comprising:

a step of dissolving fullerenes in a base oil mainly composed of a multiply alkylated cyclopentane oil or an ionic liquid containing an imide as a negative ion configured to obtain a fullerene solution; and a step of producing fullerene adducts by subjecting the fullerene solution to a heat treatment in a non-oxidizing atmosphere.

2. The method for producing a lubricating oil composition according to claim 1, wherein an oxygen gas partial pressure in the non-oxidizing atmosphere is less than or equal to 10 pascals.

3. The method for producing a lubricating oil composition according to claim 1, wherein a temperature of the heat treatment is 80° C. to 300° C.

4. The method for producing a lubricating oil composition according to claim 1, wherein the heat treatment is performed until a concentration of fullerenes in the fullerene solution is 0.1 to 0.7 with respect to a concentration of fullerenes before the heat treatment.

5. The method for producing a lubricating oil composition according to claim 1, wherein the fullerene dissolved in the base oil is $C_{60}$ or $C_{70}$ or a mixture thereof.

6. The method for producing a lubricating oil composition according to claim 1, wherein a temperature of the heat treatment in the step of producing fullerene adducts is higher than or equal to an upper limit usage temperature of the base oil, and the difference between the temperature of the heat treatment and the upper limit usage temperature is within 200° C.

7. The method for producing a lubricating oil composition according to claim 1, the method further comprising:

a step of removing an insoluble component using a membrane filter or a centrifugal separator after performing the step of obtaining the fullerene solution.

8. The method for producing a lubricating oil composition according to claim 1, wherein a heat treatment time in the step of producing fullerene adducts is 5 minutes to 24 hours.

9. The method for producing a lubricating oil composition according to claim 1, wherein the concentration of the fullerene in the fullerene solution is 1 mass ppm to 1,000 mass ppm.

10. The method for producing a lubricating oil composition according to claim 1, the method further comprising:

an adjustment step of reducing a concentration of oxygen molecules before the step of producing fullerene adducts, wherein the adjustment step and the step of producing fullerene adducts are continuously performed, and wherein, in the adjustment step, the fullerene solution is placed into an airtight metal container and the inside of the metal container is substituted with an inert gas.

11. The method for producing a lubricating oil composition according to claim 1, the method further comprising:

an adjustment step of reducing a concentration of oxygen molecules before the step of producing fullerene adducts, wherein the adjustment step and the step of producing fullerene adducts are continuously performed, and wherein, in the adjustment step, the fullerene solution is placed into an airtight container and the inside of the container is decompressed.

12. A lubricating oil composition comprising:

a base oil mainly composed of a multiply alkylated cyclopentane oil or an ionic liquid containing an imide as a negative ion; and fullerene adducts obtained by adding a component derived from the base oil to fullerenes.

* * * * *